US005427050A

United States Patent [19]

Horn

[11] Patent Number: 5,427,050

[45] Date of Patent: Jun. 27, 1995

[54] SYSTEM AND METHOD FOR PRODUCING A WAVE MOTION IN FLAGS AND OTHER INSIGNIA

[76] Inventor: Michael Horn, 35 Lucille Dr., South Setauket, N.Y. 11720

[21] Appl. No.: 135,628

[22] Filed: Oct. 14, 1993

[51] Int. Cl.[6] ..... G09F 17/00

[52] U.S. Cl. ..... 116/173; 40/218

[58] Field of Search ..... 116/173, 174; 40/218, 40/406, 407, 422, 429, 439, 412, 477; 446/178, 179, 199

[56] References Cited

U.S. PATENT DOCUMENTS

| | | | |
|---|---|---|---|
| 190,283 | 5/1861 | Turner | 116/173 X |
| 1,253,380 | 1/1918 | Hoffman | 116/174 |
| 1,256,232 | 2/1918 | Howard | 116/173 |
| 1,660,341 | 2/1928 | Lapworth | 40/218 |
| 1,777,933 | 10/1930 | O'Brien | 40/218 |
| 2,270,753 | 1/1942 | Fikes | 116/173 |
| 2,753,052 | 7/1956 | Brady | 40/477 X |
| 2,870,559 | 1/1959 | Shaughnessy | 116/173 X |
| 3,477,161 | 11/1969 | Drexler | 116/173 X |

*Primary Examiner*—William A. Cuchlinski, Jr.
*Assistant Examiner*—Willie Morris Worth

[57] ABSTRACT

A system and method for producing a horizontal wave motion in flags, pennants, banners and other insignia. The system comprises a flag or the like, a flagpole, an air blower, and a cabinet which houses and conceals the air blower. The air blower generates a free airstream of selectively chosen volume which is directed towards the lower region of the flag where the flag is attached to the flagpole. The combination of the force of the vertically directed airstream, the force of gravity, and the connection of the flag to the flagpole at one end imparts to the flag a resultant vector force which disposes the flag to unfurl and wave horizontally. The system and method for producing a horizontal wave motion in flags and the like provides for the unobtrusive manipulation of flags and the like such that a natural windblown appearance is created with no audible or visual cue as to the actuating device.

15 Claims, 1 Drawing Sheet

SYSTEM AND METHOD FOR PRODUCING A WAVE MOTION IN FLAGS AND OTHER INSIGNIA

BACKGROUND OF THE INVENTION

1. Field of the Invention

The present invention relates to a system for displaying flags, pennants, banners and other insignia, and more particularly, to a system and method for producing a wave motion in flags, pennants, banners and other insignia such that they appear to wave naturally in the absence of wind.

2. Discussion of the Prior Art

Flags, pennants and other insignia are usually displayed out of doors where they can achieve their maximum functional and aesthetic utility by waving according to the force of the wind. The majority of flags are fabricated from materials and affixed to poles or other support structures in such a manner as to enable them to wave in the presence of minimal wind. The waving motion of a flag serves a dual function. The first function being the unfurling of the flag such that the colors and symbols that comprise the flag are fully displayed. The second function being the creation of a majestic and strong appearance. A flag waving in a breeze is not generally a concern when it is displayed out of doors; however, humankind has encountered at least one environment where there is essentially a total lack of wind, even though out of doors. The surface of the earth's moon is an example of one such windless environment. The desire, however, to see the American flag wave was so strong that it was manipulated into a horizontally frozen wave by the use of multiple stays.

There exists other environments where flags are displayed in which there is no appreciable movement of air. Typically, when flags are displayed indoors, they generally encounter a lack of significant air movement; accordingly, the flags thus displayed are forced to hang limply on their poles or other support structures. There are a variety of methods for hanging flags in the unfurled position, including draping and hanging them to cause them to unfurl by the force of gravity. Although hanging or draping them to unfurl by the force of gravity allows the colors and symbols of the flag to be fully displayed, it does not solve the problem of creating a wave motion such that the flag is majestic and strong in appearance. There are, however, elaborate devices for causing a wave motion in a flag in the absence of wind, in addition to the unfurling of the flag, as evidenced by an examination of the patent arts. U.S. Pat. No. 2,870,559 to Shaughnessy discloses an example of a device which manipulates flags into natural waving configurations.

Naturally occurring winds blow prevalently in the horizontal direction; accordingly, flags that wave by the action of naturally occurring winds generally wave in the horizontal direction. Gusts of wind blowing vertically will cause the flag to assume an abnormal vertical displacement until the normally occurring horizontally oriented winds resume. The occurrence of a vertical displacement of the flag by vertically moving winds tends to reinforce the concept that has been the conventional teaching of the prior art in flag manipulation; namely, that the airstream causing a flag to wave, must be in the horizontal direction. The Shaughnessy patent, "Flag Tower Structure," mentioned above, discloses and claims a structure which provides for an airstream in the horizontal direction relative to the flag. Shaughnessy utilizes a hollow flagpole to convey a high pressure airstream to the top of the flagpole adjacent to the flag. Through longitudinally aligned holes in the flagpole, the high pressure airstream exits and imparts a horizontal force upon the flag, thereby disposing it to wave in the horizontal direction. This and similarly designed systems pose certain drawbacks. One drawback being that the airstream exiting the holes causes a loud and unpleasant sound which not only discloses the existence of the airstream actuating device, but also one which is disturbing and intrusive to observers. A second but similar drawback is the sound created by the airstream actuating device itself. To obtain the pressure necessary to create an airstream at the top of a flagpole requires a compressor, which is known for their loud and discordant sounds.

In an effort to eliminate the unpleasant sounds caused by the combination of the use of a high pressure compressor and the sound created by an airstream travelling through a hollow tube and exiting through holes contained therein, U.S. Pat. No. Des. 190,283 to Turner discloses the use of a free-air centrifugal blower mounted in proximity to the flag on a tripod structure. The free-air centrifugal blower is capable of producing a low pressure, high volume airstream quietly. In mounting the blower in proximity to the flag, a horizontally orientated airstream is created to wave the flag without having to travel through the flagpole. Although Turner has overcome the noise drawbacks of Shaughnessy, a distinct visual drawback has emerged. The placement of the free-air centrifugal blower immediately adjacent to the flag, along with its associated support structure, detracts from the aesthetic beauty of the waving, fully unfurled flag.

The traditional decorum for displaying a flag is the fastening of the flag to the upper portion of a free standing flagpole whose length is substantially greater than the dimensions of the flag. When displayed in this manner, a gentle wind causes the flag to unfurl and wave thereby causing its colors and symbols to be fully and majestically displayed. The wind creates a natural viewing environment which is quiet and does not distract the observer. Accordingly, in order to preserve this viewing environment in locations which lack winds, an artificial airstream must be created which is both quiet and transparent to the observer.

SUMMARY OF THE INVENTION

The present invention is directed to a system and method for producing a horizontal wave motion in flags. The system comprises a flag, a vertically orientated support structure, or flagpole, and a device for generating a vertically orientated airsteam of preselected volume, or air blower. The flag is connected to the vertically orientated support structure such that the flag is constrained from movement on the end which is connected to the vertically orientated support structure. The device for generating the vertically orientated airstream of preselected volume is positioned in proximity to the base region of the vertically orientated support structure and directs the airstream towards the lower portion of the flag where the flag is connected to the vertically orientated support structure. The system also comprises a cabinet which houses tile device for generating the vertically orientated airstream.

Directing the vertically oriented airstream towards the lower portion of the flag, where it is attached to the flagpole, in the direction of the opposite corner of the flag results in the airstream impinging upon the flag, and through the resultant disposition of its force, causes a wave to propogate in the fabric of the flag. The wave is a simple circular type which propogates out toward the opposite corner of the flag. Given the restriction of movement imposed by the connection of the flag to the flagpole and gravity, a resultant wave is immediately created that propogates in the horizontal direction across the fabric of the flag. This resultant horizontal wave causes the flag to unfurl and wave in a manner identical to that of a flag blowing naturally in the wind.

The system and method for producing a horizontal wave motion in flags provides for a simple and inexpensive manner of displaying flags in windless environments, such as indoor displays, while maintaining the traditional display decorum for flags and the like. The system and method provides for a natural viewing environment which is quiet and does not distract the observer. The system is easy to maintain and existing flag displays can be easily modified.

DETAILED DESCRIPTION OF THE PREFERRED EMBODIMENTS

The present invention is directed to a system and method for producing a horizontal wave motion in flags, pennants, banners and other insignia. A vertically orientated, free-airstream of selectively chosen volume is directed towards the lower region of the flag where the flag is attached to the flagpole. The combination of the force of the impinging airstream, the force of gravity, and the connection of the flag to the flagpole causes a waveform which propogates through the flag thus causing it to unfurl and wave in a manner identical to that of a flag blowing naturally in the wind.

Figure 1:
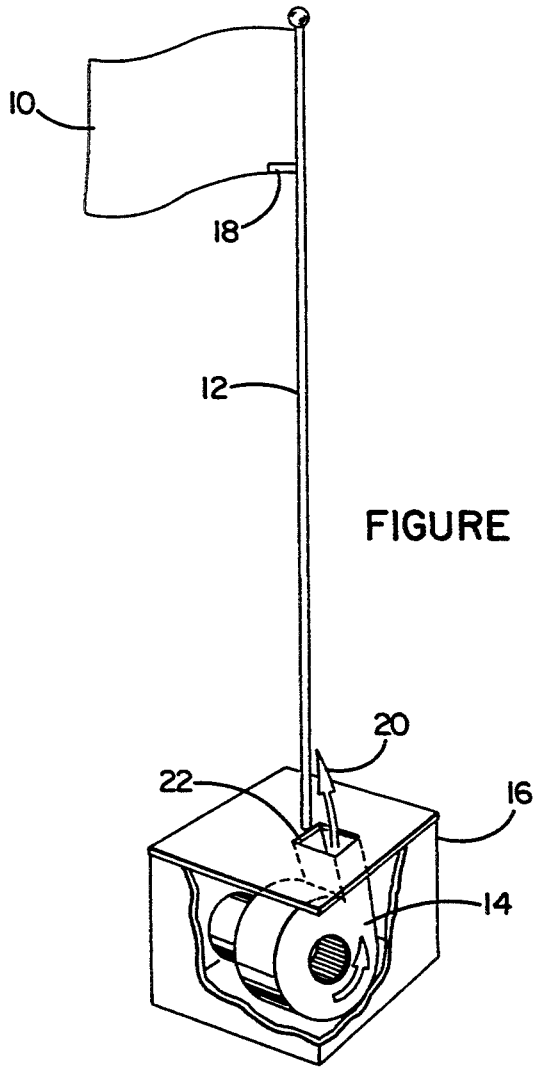
FIG. 1 is a diagrammatic representation of the system for producing a wave motion in flags, pennants, banners, and other insignia of the present invention.

Referring to FIG. 1, there is shown a diagrammatic representation of the system for producing a wave motion in flags. The system comprises a flag 10, a pole or flagpole 12 for holding the flag 10, an air blower 14 for providing the vertically orientated free airstream, a cabinet 16 which houses and conceals the air blower 14 and supports the flagpole 12. Attached to the lower portion of the flag 10, immediately adjacent to the flagpole 12 is a stay 18 which tends to hold the flag 10 in a fixed position.

The flag 10 can be fabricated from any of the numerous materials presently utilized in the manufacturing of flags including cotton, silk or nylon. The only constraint on the material is that is be flexible such that it would wave in a light breeze. The dimensions of the flag 10 can vary depending upon the area where the flag 10 is to be displayed and upon the personal preference of the owner. The stay 18 is fixed to the flag 10 to ensure that the flag 10 remains within the vertical airstream provided by the air blower 14. A more detailed explanation of the use and operation of the stay 18 is given subsequently.

The flagpole 12 can be constructed from any suitably rigid material such as fiberglass, aluminum or stainless steel. The length of the flagpole 12 should be approximately three times the length of the flag 10 for effective system operation. For example, an eighteen inch flag requires a flagpole of approximately fifty-four inches in length. The flag-length to flagpole-length ratio of approximately three-to-one can vary slightly based upon differences in fabric weight and air blower 14 output. The flag 10 can be attached to the flagpole 12 by any number of a plurality of connecting devices such as a rope or cord threaded through grommets in a seam of the flag 10. The type of connection does not matter as long as the flag 10 is constrained from substantial movement at the end which is attached to the flagpole 12. The flagpole 12 is attached to the cabinet 16 to ensure that it is held upright in a vertical orientation. Note; however, that the flagpole 12 can be supported by means other than attachment to the cabinet 16.

The air blower 14 is a simple electrical centrifugal blower which can be powered by a rechargeable battery or a standard A.C. supply. Alternative devices, such as fans or compressors can be utilized in place of the centrifugal blower 14, however, centrifugal blowers generally are quieter than compressors, and more powerful than fans. The output of the air blower 14 required to cause the flag 10 to wave is related to the length of the flag 10. As the length of the flag 10 increases, the output of the air blower 14 must increase proportionally. The relationship between air blower output and flag length is approximately three-to-one with a minimum air blower output of approximately eighteen cubic feet per minute for a six inch flag or less. Therefore, for an eighteen inch flag, an air blower output of approximately fifty-four cubic feet per minute is required. Accordingly, once the flag 10 and flagpole 12 sizes are determined, the appropriate size air blower 14 can be determined. The air blower 14 is mounted within the cabinet 16 at the base region of the flagpole 12. The cabinet 16 comprises an opening, 22 such as a screen or grating, through which the output of the air blower 14 is directed. The cabinet 16 serves to conceal the air blower 14 from sight in such a manner as to prevent it from being a distraction to anyone observing the flag 10. Additionally, the cabinet 16 can be decorated to fit in with the decor of the area where the flag 10 is being displayed. Since the air blower 14 is a centrifugal blower and thus very quite, the casual observer would be unable to detect the source of the airstream causing the flag 10 to wave.

The size of the entire system can vary from as small as a desk top model to a full size model which is equal in size to outdoor displays. Regardless of the size of the system, the relationship between the size of the flag 10 and the flagpole 12, and the size of the flag 10 an the air blower 14, as described above, must be maintained for proper system operation.

Figure 2:
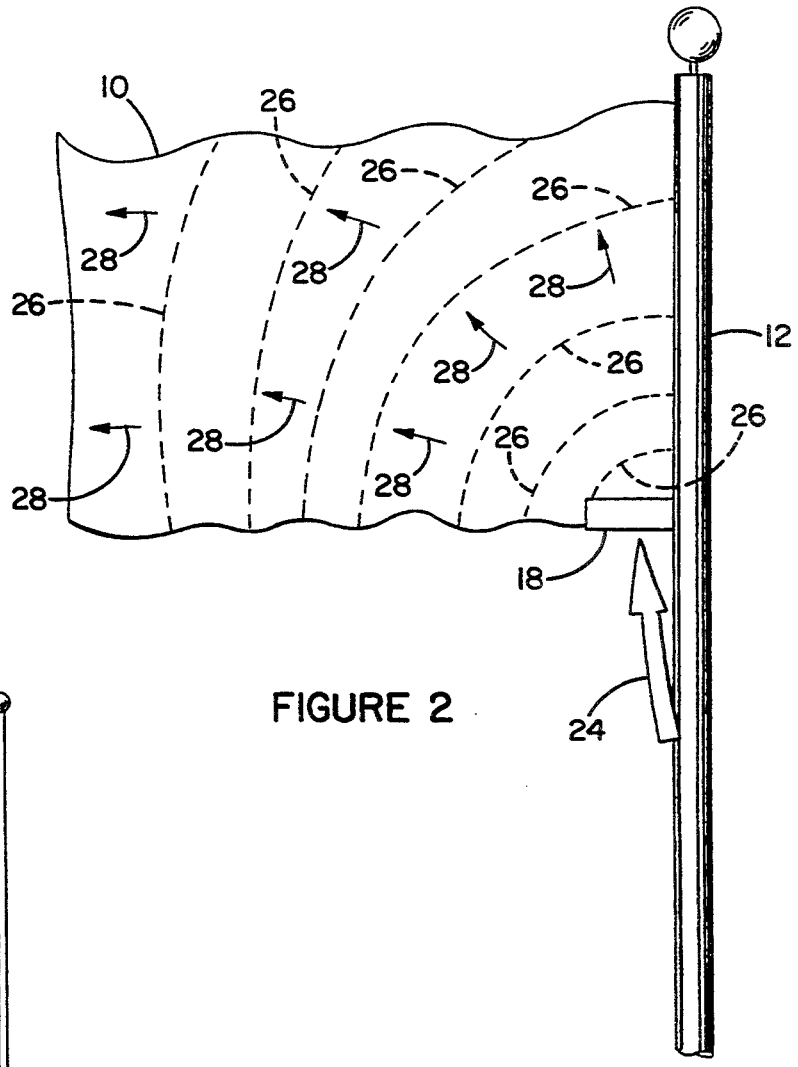
FIG. 2 is a diagrammatic representation of a continuous airstream directed towards a flag and the resultant wave motion created in the flag.

The airstream produced by the air blower 14 is directed substantially in the vertical direction, indicated by arrow 20, towards the flag 10 such that the airstream impinges upon the lower quadrant of the flag 10 in the area where the stay 18 is fastened, and travels in the direction of the opposite corner of the flag 10. Referring now to FIG. 2, there is shown a diagrammatic representation of a continuous vertically oriented, free-airstream, directed towards the flag 10 and the resultant wave motion created in the flag 10. The vertically orientated, free-airstream is indicated by arrow 24. The force of the airstream on the lower quadrant of the flag 10 creates a circular wave pattern, shown by dotted lines 26, to form in the flag 10 and which propogates radially in a direction opposite from where the airstream impinges on the flag 10, as indicated by arrows 28. Because the flag 10 is fixed on one end to the flagpole 12 and restrained to remain in the airstream, the circular waveform decays into only its horizontal component which then travels across the flag 10. As a consequence of the decay of the circular wave only into its horizontal component, the flag 10 takes on a wave in the horizontal direction despite the vertical deposition of the impinging airstream.

As explained previously, the stay 18 is placed in the lower portion of the flag 10, adjacent to where the flag 10 is attached to the flag pole 12 to further facilitate wave propagation by tending to maintain the lower portion of the flag 10 within the vertically directed free airstream. The stay 18 is rectangular in shape and approximately one tenth the size of the flag 10. As larger flags, typically over two feet in length, wave horizontally, a rigid stay tends to cause a peturbation in the wave and predisposes it to become out of balance. Once out of balance, the flag will experience intermittent vertical displacement and an unnatural kinking. Accordingly, a flat, thin cross-section, flexible stay should be utilized. In utilizing a stay of this type, the stay itself will oscillate from side to side with the flag. Given that the stay is flexible, it has a restoring force or spring constant, which varies with the particular material, that tends to center the stay, thereby bringing the entire lower portion of the flag back into the airstream.

Although shown and described is what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed:

1. A system for producing a horizontal wave motion in flags, said system comprising:

(a) a flag;

(b) a vertically oriented support structure for holding said flag, a first end of said flag being connected to said vertically oriented support structure such that said flag is constrained from movement at said first end;

(c) means for supporting vertically oriented support structure; and (d) means for generating a vertically oriented free airstream of preselected volume positioned in proximity to a base region of said vertically oriented support structure, said means for generating a vertically oriented free airstream being operable to direct said vertically oriented free airstream substantially along an external region of said vertically oriented support structure from said base region towards a lower portion of said flag where said flag is connected to said vertically oriented support structure and angled in the direction of an upper corner of a second end of said flag.

2. The system for producing a horizontal wave motion in flags according to claim 1, wherein said means for supporting further comprising a cabinet for housing said means for generating a vertically orientated airstream of preselected volume and rigidly holding said vertically oriented support structure, said cabinet being constructed from a rigid, non-corroding material.

3. The system for producing a horizontal wave motion in flags according to claim 2, wherein said flag comprises a stay fastened to the lower portion thereof in the proximity of said vertically oriented support structure for maintaining said flag in said vertically oriented airstream.

4. The system for producing a horizontal wave motion in flags according to claim 3, wherein said stay is rectangular in shape, thin in cross-section and formed from a flexible material.

5. The system for producing a horizontal wave motion in flags according to claim 4, wherein said stay is one tenth the length of said flag in length.

6. The system for producing a horizontal wave motion in flags according to claim 5, wherein said vertically orientated support structure is a flagpole, said flagpole being formed from a rigid, non-corroding material and having a length of three times the length of said flag.

7. The system for producing a horizontal wave motion in flags according to claim 6, wherein said means for generating a vertically orientated airstream of preselected volume is an electric centrifugal blower, said electric centrifugal blower being operable to produce an airstream volume, in cubic feet per minute, equal to that of three times the length of said flag with a minimum of eighteen cubic feet per minute for flags being six inches or less in length.

8. A system for producing a horizontal wave motion in flags thereby causing the flags to unfurl and wave in a manner analogous to that of flags waving naturally in the presence of wind, said system comprising:

(a) flag;

(b) a vertically oriented support structure for holding said flag, a first end of said flag being connected to said vertically oriented support structure such that said flag is constrained from movement at said first end;

(c) means for generating a vertically oriented free airstream of preselected volume positioned in proximity to a base region of said vertically oriented support structure, said means for generating a vertically oriented free airstream being operable to direct said vertically oriented free airstream substantially along an external region of said vertically oriented support structure from said base region towards a lower portion of said flag where said flag is connected to said vertically oriented support structure and angled in the direction of an upper corner of a second end of said flag; and (d) a cabinet for housing said means for generating a vertically oriented free airstream of preselected volume and rigidly holding said vertically oriented support structure, said cabinet being constructed from a rigid, non-corroding material.

9. The system for producing a horizontal wave motion in flags according to claim 8, wherein said flag comprises a stay fastened to the lower portion thereof in the proximity of said vertically oriented support structure for maintaining said flag in said vertically oriented airstream.

10. The system for producing a horizontal wave motion in flags according to claim 9, wherein said stay is rectangular in shape, thin in cross-section and formed from a flexible material.

11. The system for producing a horizontal wave motion in flags according to claim 10, wherein said stay is one tenth the length of said flag in length.

12. The system for producing a horizontal wave motion in flags according to claim 11, wherein said vertically orientated support structure is a flagpole, said flagpole being formed from a rigid, non-corroding material and having a length of three times the length of said flag.

13. The system for producing a horizontal wave motion in flags according to claim 12, wherein said means for generating a vertically orientated airstream of preselected volume is an electric centrifugal blower, said electric centrifugal blower being operable to produce an airstream volume, in cubic feet per minute, equal to that of three times the length of said flag with a minimum of eighteen cubic feet per minute for flags being six inches or less in length.

14. A method for producing a horizontal wave motion in flags, said method comprising the steps of:

(a) supporting a vertically oriented support structure;

(b) displaying a flag on a vertically oriented support structure having a length of three times that of the length of said flag and in such a manner as to constrain movement of said flag on a first side where said flag is connected to said vertically oriented support structure;

(c) generating a vertically oriented free airstream of preselected volume; and (d) directing said vertically oriented free airstream of preselected volume substantially along an external region of said vertically oriented support structure, from a base region of said vertically oriented support structure towards a lower portion of said flag where said flag is connected to said vertically oriented support structure and angled in the direction of an upper corner of a second end of said flag.

15. The method for producing a horizontal wave motion in flags according to claim 14, wherein said step of generating a vertically oriented airstream of preselected volume comprises generating an airstream volume in cubic feet per minute, equal to that of three times the length of said flag with a minimum output of eighteen cubic feet per minute for flags being six inches or less in length.

* * * * *